US006439349B1

(12) United States Patent
Smith

(10) Patent No.: US 6,439,349 B1
(45) Date of Patent: Aug. 27, 2002

(54) METHOD AND APPARATUS FOR ASSIGNING NEW HALL CALLS TO ONE OF A PLURALITY OF ELEVATOR CARS

(75) Inventor: Rory Smith, Germantown, TN (US)

(73) Assignee: Thyssen Elevator Capital Corp., Whittier, CA (US)

( * ) Notice: Subject to any disclaimer, the term of this patent is extended or adjusted under 35 U.S.C. 154(b) by 0 days.

(21) Appl. No.: 09/746,784

(22) Filed: Dec. 21, 2000

(51) Int. Cl.[7] ..... B66B 1/18
(52) U.S. Cl. ..... 187/382; 187/247
(58) Field of Search ..... 187/380, 381, 187/382, 386, 388, 247

(56) References Cited

U.S. PATENT DOCUMENTS

| | | | | |
|---|---|---|---|---|
| 4,009,766 A | | 3/1977 | Satoh | 187/29 R |
| 4,363,381 A | | 12/1982 | Bittar | |
| 4,536,842 A | * | 8/1985 | Yoneda et al. | 187/29 R |
| 4,838,385 A | | 6/1989 | Ekholm | 187/101 |
| 4,926,976 A | | 5/1990 | Schroder | 187/125 |
| 4,930,603 A | | 6/1990 | Brenner | 187/125 |
| 4,991,694 A | | 2/1991 | Friedli | 187/127 |
| 4,993,518 A | | 2/1991 | van Straaten et al. | 187/127 |
| 5,024,295 A | * | 6/1991 | Thangavelu | 187/125 |
| 5,056,628 A | | 10/1991 | Aime | 187/127 |
| 5,168,133 A | | 12/1992 | Bahjat et al. | 187/125 |
| 5,239,141 A | | 8/1993 | Tobita et al. | 187/127 |
| 5,252,790 A | | 10/1993 | Aime | 187/127 |
| 5,276,295 A | | 1/1994 | Kameli | 187/132 |
| 5,305,194 A | | 4/1994 | MacDonald | 364/400 |
| 5,305,198 A | * | 4/1994 | Schroder et al. | 364/402 |
| 5,389,748 A | | 2/1995 | Burke et al. | 187/247 |
| 5,427,206 A | * | 6/1995 | Powell et al. | 187/387 |
| 5,511,635 A | | 4/1996 | Kameli | 187/392 |
| 5,563,386 A | * | 10/1996 | Powell et al. | 187/382 |
| 5,689,094 A | | 11/1997 | Friedli et al. | 187/384 |
| 5,780,789 A | | 7/1998 | Tsuji | 187/382 |
| 6,000,504 A | | 12/1999 | Koh et al. | 187/382 |
| 6,237,721 B1 | * | 5/2001 | Siikonen | 187/382 |

FOREIGN PATENT DOCUMENTS

| | | |
|---|---|---|
| EP | 0321657 | 6/1989 |
| EP | 0324068 | 7/1989 |
| EP | 0365782 | 5/1990 |
| EP | 0407731 | 1/1991 |
| EP | 0443188 | 8/1991 |
| EP | 0508094 | 10/1992 |
| EP | 0565864 | 10/1993 |
| EP | 0631965 | 1/1995 |
| EP | 0663366 | 7/1995 |
| EP | 0699617 | 3/1996 |
| EP | 0709332 | 5/1996 |
| JP | 1192686 | 8/1989 |
| JP | 4028681 | 1/1992 |
| JP | 6156893 | 6/1994 |
| JP | 6293478 | 10/1994 |
| JP | 9255245 | 9/1997 |

* cited by examiner

*Primary Examiner*—Jonathan Salata
(74) *Attorney, Agent, or Firm*—White & Case LLP

(57) ABSTRACT

The present invention provides a method and apparatus for use in elevator systems for assigning new hall calls to one of a plurality of available elevator cars. According to the invention, a call cost is calculated for each car for accepting the new hall call. The call cost is a function of the estimated time to the desired destination of the passenger requesting the new hall call and of the delay that other passengers who are using the elevator car will experience. In one embodiment, a destination is inferred for the passenger requesting the new hall call. In another embodiment, the passenger requesting the hall call may input a desired destination at the time the hall call request is made. The elevator system of the present invention allows for use of both standard up/down hall call entry devices and destination entry devices that allow a particular destination to be entered by a passenger at the time a hall call is requested.

10 Claims, 2 Drawing Sheets

METHOD AND APPARATUS FOR ASSIGNING NEW HALL CALLS TO ONE OF A PLURALITY OF ELEVATOR CARS

BACKGROUND OF THE INVENTION

1. Field of the Invention

The present invention relates to elevator systems having a plurality of elevator cars that operate in a plurality of elevator shafts and that serve a plurality of elevator landings. In particular, the present invention provides a method and apparatus for assigning new hall calls to one of the elevator cars in the elevator system.

2. Description of the Related Art

Existing hall call allocation systems and methods use criteria, such as waiting time, time to destination, energy consumption, and elevator usage, with neural networks, generic algorithms, and/or fuzzy logic to find an optimum solution for assigning a new hall call to one of a group of available elevator cars. These existing systems and methods generally fall into one of two categories; Estimated Time of Arrival ("ETA") based systems and destination dispatch based systems.

The prior art systems and methods have certain inherent shortcomings that limit their efficiencies. ETA based systems calculate the amount of time required for each available elevator to answer a new hall call. The elevator with the lowest time required to answer the call, i.e., the car that will arrive first, is assigned the new hall call. While ETA based systems have some advantages, they do not adequately evaluate the negative impact of a new hall call assignment on existing call assignments. For example, when a passenger enters a new hall call and it is accepted by an elevator car carrying existing passengers that are traveling to a floor beyond the floor where the newly assigned hall call was entered, the existing passengers will be delayed by the time needed to pick up the new passenger and, depending upon the new passenger's desired destination, the existing passengers may be delayed by the time needed to drop off the new passenger.

Destination dispatch systems also have shortcomings. For example, they require a destination input device at each elevator landing and usually have no call input devices in the elevator car. Because destination dispatch systems require entry devices at every elevator landing, they must make an instant call assignment and inform a waiting passenger which car to enter. This instant assignment does not permit an improved assignment if conditions change during the time period between call entry and car arrival. Thus, an elevator hall call assignment system and method that does not require destination entry devices at every elevator landing and that takes into account the delay that a new hall call assignment will have on existing passengers would greatly improve the elevator art.

SUMMARY OF THE INVENTION

An elevator system having a plurality of elevator cars that are capable of making stops at a plurality of elevator landings may use a computer implemented method to assign a new hall call to one of the elevator cars. In some situations, the elevator cars may have previously been assigned car calls and hall calls, i.e. they have may have existing car calls and existing hall calls. The method comprises receiving a new hall call signal from an elevator landing where a passenger is requesting an elevator car and, for each elevator car, calculating a call cost for accepting the new hall call.

The call cost for each elevator car is calculated by inferring a destination for the passenger(s) entering the new hall call. Destinations may be inferred from statistical data or other means that are known in the art. After the destination is inferred, an estimated time to the inferred destination ("ETID") is calculated for each car. For each car, system degradation factors ("SDFs") are calculating for any and all existing hall calls and car calls. A system degradation factor for an existing car call is a function of the delay that one or more passengers traveling on the elevator car will experience as a result of the car's acceptance of the new hall call. A system degradation factor for an existing hall call is a function of the delay that the passenger(s) who requested the existing hall call will experience as a result of the elevator car's acceptance of the new hall call.

Once the estimated time to the inferred destination is calculated and the system degradation factors are calculated, the call cost value ("CC") for an elevator car can be calculated according to the following equation:

$$CC = \sum_{k=1}^{n} SDF_k + ETID$$

wherein the elevator car has a quantity of n existing car and hall calls(k). The new hall call is then assigned to the elevator car having the lowest call cost value.

In elevator systems that employ destination entry devices on some of the elevator landings, or other systems where some passengers' destinations are known at the time they enter new hall calls, the above method may be modified to achieve better efficiencies. The modified method may be used in elevator systems where some new hall calls contain destination information indicating a passenger's specific desired destination and some do not contain destination information indicating a passenger's specific desired destination. For new hall calls containing destination information, an estimated time to the actual destination ("ETD") is calculated for each elevator car. For new hall calls not containing destination information, a destination is inferred for the new hall call and an estimated time to the inferred destination is calculated for each elevator car in the system. Also, for each car, system degradation factors for existing hall calls and existing car calls are calculated. Finally, a call cost value for accepting each new hall call is calculated as follows:

for new hall calls accompanied by destination information the CC is calculated as follows:

$$CC = \sum_{k=1}^{n} SDF_k + ETD$$

wherein each car has a quantity of n existing car and hall calls(k); and for new hall calls not accompanied by destination information the CC is calculated as follows:

$$CC = \sum_{k=1}^{n} SDF_k + ETID$$

wherein each car has a quantity of n existing car and hall calls (k). The elevator cars having the lowest call cost is assigned to the new hall call.

The improved assignment method described above is preferably implemented in an elevator system having a plurality of elevator landings and a plurality of elevator cars that are available to answer new hall calls. The system may have internal elevator car destination entry devices for allowing passengers to enter desired destinations after they enter an elevator car. The system may also have, on some landings, external elevator car destination entry devices for allowing passengers who are requesting a new hall call to enter a desired destination. A computer touch screen is particularly well suited for use as an external elevator car destination entry device. On other elevator landings, the system may contain standard up/down hall call entry devices that allow passengers to hail elevator cars. The elevator system employs an elevator controller that is electronically interfaced with these devices and is programmed to receive signals from these devices and calculate, for each available elevator cars, call costs for accepting one or more of the new hall calls. The elevator controller is further programmed to assign new hall calls to the elevator cars having the lowest call costs. The controller may be configured to recalculate call cost and re-assign new hall calls as passengers enter or exit elevator cars and/or as passengers enter new car calls. The elevator controller may also be interfaced with elevator load sensors on each elevator car so that each elevator car's load can be calculated and used to approximate the number of passengers in the elevator car. This approximation can be used to improve call cost calculations.

DETAILED DESCRIPTION OF THE INVENTION

Figure 1:
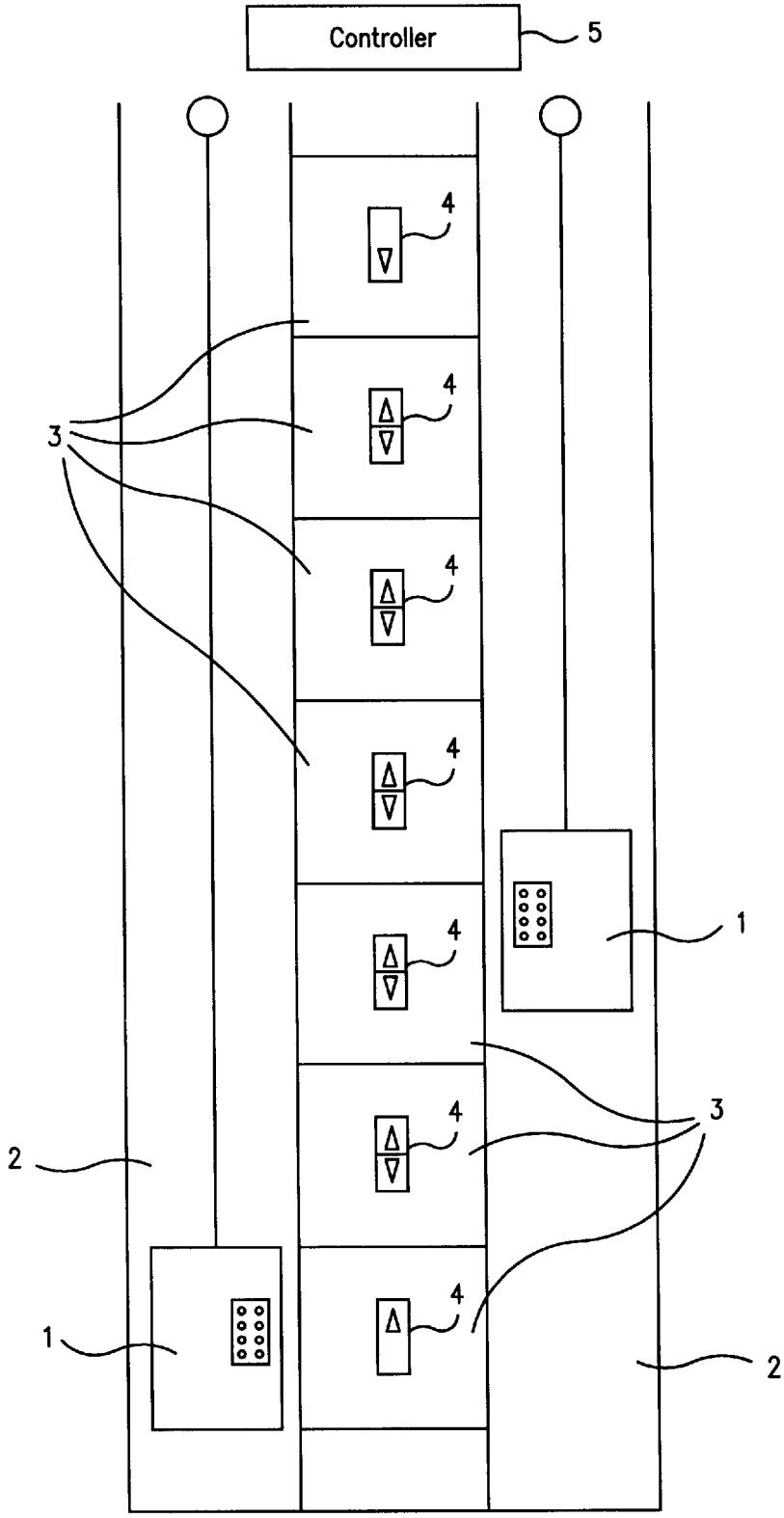
FIG. 1 PRIOR ART
FIG. 1 illustrates a typical elevator system in a building having a plurality of elevator cars operating in a plurality of elevator shafts.

Referring now to FIG. 1, an elevator system comprises a plurality of elevator cars 1 residing in a plurality of elevator shafts 2 that are available to pick up passengers at various elevator landings 3. Each of the various elevator landings 3 has a standard hall call entry device 4, which typically, but not necessarily, comprises an up/down button. The hall call entry devices 4 are interfaced with an elevator controller 5 via standard interface device, such as a cable (not shown). When a passenger on an elevator landing 3 enters a hall call by activating the hall call entry device 4, the elevator controller 5 infers a destination for the passenger. The destination may be inferred from statistical data and may vary depending on factors known in the elevator art, such as time of day and day of week. The elevator controller 5 uses the inferred destination to calculate an ETID. The ETID may be calculated in accordance with the parameters and equations set forth in Table 1 below.

TABLE 1

| |
|---|
| ETA = Estimated Time of Arrival |
| ETID = Estimated Time to Inferred Destination |
| ADT = Accelerate-Decelerate Time |
| NSP = Number of Stops for ETA |
| NSP1 = Number of Stops for ETID |
| FSTT = Full Speed Travel Time for ETA |
| FSTT1 = Full Speed Travel Time for ETID |

TABLE 1-continued

| |
|---|
| DODCT = Door Open Close Time |
| DDT = Door Dwell Time |
| ETA = (NSP * ADT) + FSTT + (NSP *DODCT) + (NSP*DDT) |
| ETID = ETA + (NSP1 * ADT) + FSTT1 + (NSP1 * DODCT) + (NSP1*DDT) |

In addition to calculating the ETID for each elevator car 1, the elevator controller 5 also calculates system degradation factors for each car's existing hall calls and car calls. System degradation factors are parameters that take into account the delay passengers relying on an elevator car for their transportation will experience as a result of the elevator car accepting a new hall call. For example, if elevator car A is at a landing in a building lobby and has two passengers X and Y who are traveling to the $5^{th}$ and $8^{th}$ floor respectively and passenger Z who wants to travel to the $7^{th}$ floor executes a new hall call on the third floor, the SDF for passenger X's car call is the time it will take to pick up passenger Z. The SDF for passenger Y's car call is the time to pick up passenger Z on the third floor and drop off passenger Z on the $7^{th}$ floor. Values for the SDFs are readily calculated from standard elevator parameters such as those in Table 1. Those skilled in the art will recognize that, while not essential to the practice of the present invention, other standard elevator operating parameters may be used at full value or in a weighted value form to improve the accuracy of SDF calculations.

Once each car's SDFs and ETID are calculated, the controller can calculate a call cost ("CC") for each car as follows:

$$CC = \sum_{k=1}^{n} SDF_k + ETID$$

wherein each car has a quantity of n existing car and hall calls (k).

Because the actual destination of a passenger requesting a new hall call is not, in most cases, known until the passenger enters an elevator car and selects an actual destination, there is some uncertainty associated with the call cost value for unanswered hall calls, i.e. hall calls that an elevator car has not yet responded to. In some embodiments, the elevator controller may re-calculate call costs as more passenger information becomes known and may re-assign new hall calls as a result of the re-calculations. Additionally, the number of passengers often affects the call cost calculations. The number of passengers can be initially inferred and then later corrected based upon elevator load, which is easily measured with standard elevator load sensors that are interfaced with the elevator controller. Once the number of passengers is known subsequent calculations of CC and SDF may use the corrected information.

In some elevator systems, some passengers may input their actual desired destinations when they request a hall call. Some of the new hall call signals may contain destination information indicating a passenger's desired destination and some of the new hall call signals may not have destination information. For each elevator car in the system, the controller calculates a call cost for accepting each of the new hall call signals. In order to calculate the call cost of the new hall calls, the controller first calculates, for each elevator car, an estimated time to the actual destination ("EDT"), if destination information accompanies the hall call signal, or an ETID, if destination information does not accompany the new hall call signal. The controller also calculates SDFs for each car's existing hall calls and existing car calls in the same manner described previously. Call cost values are calculated according to the following equations:

for hall calls accompanied by destination information, the parameters and equations set forth in Table 2 are used with the following equation to calculate the CC:

$$CC = \sum_{k=1}^{n} SDF_k + ETD$$

wherein each elevator car has a quantity of n existing car and hall calls (k), for hall calls not accompanied by destination information, the parameters and equations set forth in Table 1 are used with the following equation to calculate the CC:

$$CC = \sum_{k=1}^{n} SDF_k + ETID$$

wherein each elevator car has a quantity of n existing car and hall calls (k). After the CC is calculated for each car, the controller then compares the CC for each car and assigns the new hall call to the car with the lowest CC value.

TABLE 2

| |
|---|
| ETA = Estimated Time of Arrival |
| ETD = Estimated Time to Destination |
| ADT = Accelerate-Decelerate Time |
| NSP = Number of Stops for ETA |
| NSP1 = Number of Stops for ETD |
| FSTT = Full Speed Travel Time for ETA |
| FSTT1 = Full Speed Travel Time for ETD |
| DODCT = Door Open Close Time |
| DDT = Door Dwell Time |
| ETA = (NSP * ADT) + FSTT + (NSP *DODCT) + (NSP*DDT) |
| ETD = ETA + (NSP1 * ADT) + FSTT1 + (NSP1 * DODCT) + (NSP1*DDT) |

As more passenger information becomes available, such as the number of passengers and/or their actual destinations, the elevator controller can re-calculate and re-assign new hall calls. Once the number of passengers is known subsequent calculations of CC and SDF may use the corrected information.

Figure 2:
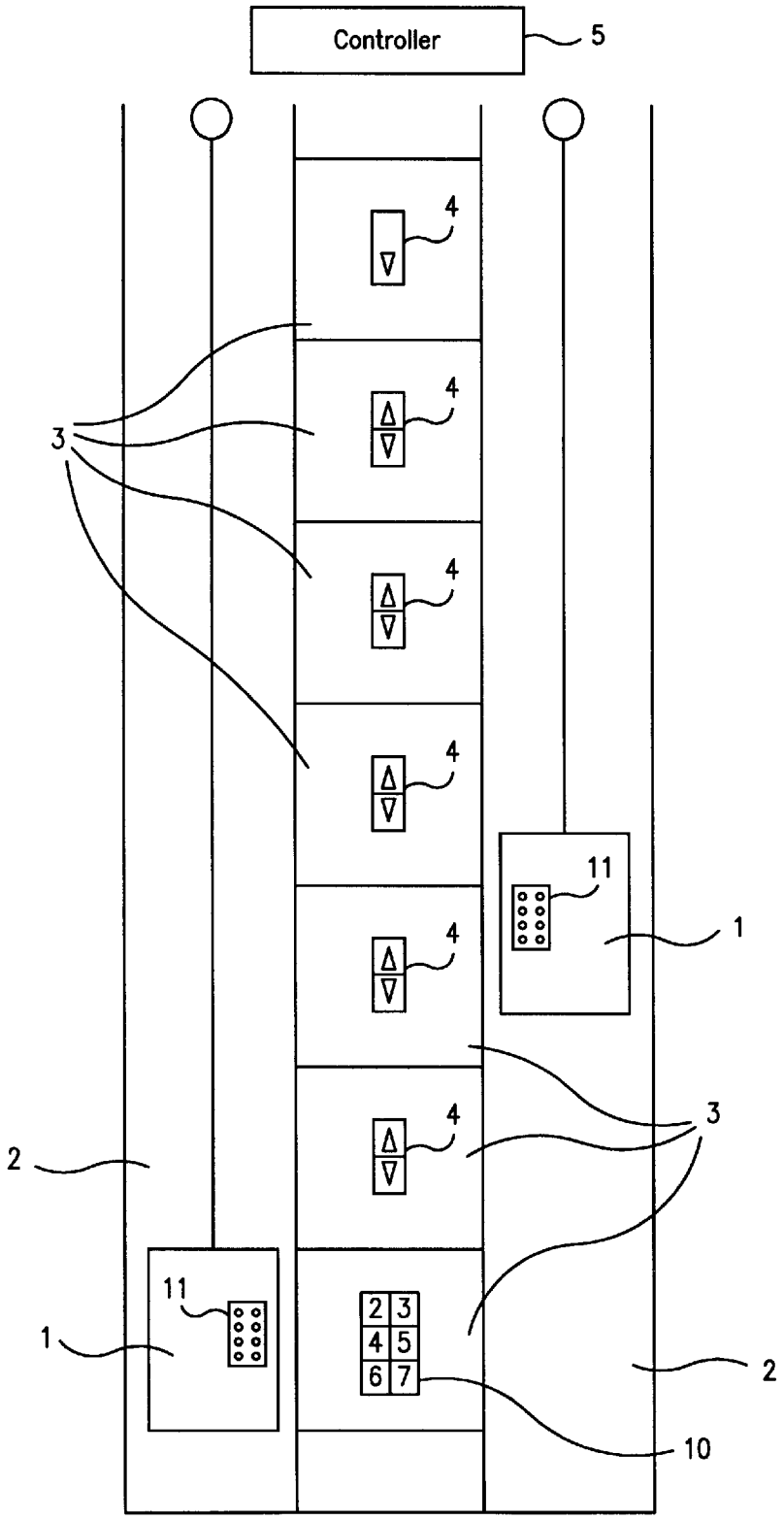
FIG. 2 illustrates an elevator system having an external elevator entry device at one or more elevator landings, up/down hall call entry devices at other elevator landings, and a plurality of elevator cars with internal elevator destination entry devices.

One method of instantly determining a passenger's actual desired destination at the time the passenger executes a new hall call is to use an external elevator destination entry device. Referring now to FIG. 2, an external elevator destination entry device 10, such as a computer touch screen, is interfaced with an elevator controller 5. The external elevator destination entry device 10 may be located at all floors or at selected floors. In one embodiment, an elevator landing in a lobby of a building employs an external elevator destination entry device 10 and other elevator landings employ standard up/down hall call entry devices 4. Each elevator car 1 in the elevator system also contains internal elevator destination entry devices 11 that allow passengers riding inside the elevator cars 1 to enter their destinations or change their destinations. The elevator controller 5 is programmed to receive a plurality of new hall call signals and to calculate call costs for each elevator car. Some of the new hall calls, particularly those originating from the lobby landing, which has an external elevator destination entry device 10, may contain destination information indicating a passenger's specific desired destination. Some new hall calls, particularly those originating from landings without external elevator destination entry devices 10, may not contain information destination information. For hall call signals containing destination information, the controller calculates an ETD, using the parameters and equations set forth in Table 2. For hall call signals not containing destination information, the controller infers a destination and calculates an ETID as described above, using the parameters and equation in Table 1. The controller also calculates SDFs for each car's previously existing car calls and hall calls are calculated. The SDFs and the ETIDs or ETDs for each car are used by the controller to calculate the car's call cost and controller assigns the new hall calls to the elevator cars having the lowest call costs.

In some embodiments, the elevator controller 5 may be programmed to re-calculate each car's call cost as new data for the car becomes available. For example, a load sensor can be used to send load data to the controller and the load data can be used to infer the number of passengers entering the car. Moreover, as discussed above, for hall calls not accompanied by destination information, actual destination information may be used to re-calculate call cost as soon as it becomes known. Actual destination information typically becomes known when a passenger enters an elevator car 1 and enters a destination in the internal elevator car destination entry device 11.

What is claimed:

1. A computer implemented method for assigning a new hall call to one of a plurality of elevator cars in an elevator system, wherein the cars are capable of stopping at a plurality of elevator landings and wherein the elevator cars may have existing car calls and existing hall calls, the method comprising:

receiving a new hall call signal, the new hall call signal originating at an elevator landing;

for each car, determining a call cost ("CC") for accepting the new hall call as follows:

(a) inferring a destination and calculating an estimated time to the inferred destination ("ETID");

(b) calculating a system degradation factor ("SDF") for each elevator car's existing hall calls and car calls; and (c) calculating the call cost ("CC") value according to the following equation:

$$CC = \sum_{k=1}^{n} SDF_k + ETID$$

wherein the elevator car has a quantity of n existing car and hall calls (k); and assigning the new hall call to the elevator car having the lowest call cost.

2. The method of claim 1, further comprising:

recalculating the call cost for each car in which a passenger enters or leaves; and reassigning the new hall call to the elevator car having the lowest call cost.

3. The method of claim 1 further comprising:

re-calculating the call cost for any elevator car that has received a new car call; and reassigning the new hall call to the elevator car having the lowest call cost.

4. A computer implemented method for assigning a new hall call to one or more of a plurality of elevator cars in an elevator system where some new hall call signals contain destination information indicating a specific desired destination and where some hall call signals do not contain information indicating a specific desired destination, wherein the cars are capable of stopping on a plurality of elevator landings and wherein the cars may have existing car calls and existing hall calls, the method comprising:

receiving a new hall call signal;

for each elevator car, calculating a call cost for accepting each of the new hall calls as follows:

(a) if the new hall call signal contains destination information, calculating an estimated time to the desired destination ("ETD");

(b) if the new hall call signal does not contain destination information, inferring a desired destination and calculating the estimated time to the inferred destination ("ETID");

(c) calculating system degradation factors ("SDFs") for each elevator car's existing car calls and hall calls;

(d) determining the call cost value ("CC") in accordance with the following equations:

if the new hall call signal contains destination information, $$CC = \sum_{k=1}^{n} SDF_k + ETD$$

wherein there are n existing car and hall calls (k), and if the new hall call signal does not contain destination information, $$CC = \sum_{k=1}^{n} SDF_k + ETID$$

wherein there are n existing car and hall calls (k); and assigning the new hall calls to the cars with the lowest call costs.

5. The method of claim 4, further comprising recalculating the call cost for each elevator car in which a passenger enters or exits;

and reassigning the new hall call to the elevator car having the lowest call cost.

6. The method of claim 4, further comprising:

for any elevator car that has received a new car call, recalculating the call cost; and reassigning the new hall call to the elevator car having the lowest call cost.

7. An elevator system for assigning a new hall call to one of a plurality of available elevator cars comprising:

a plurality of elevator car landings;

an elevator hall call entry device at each landing, the hall call entry device capable of generating a new hall call signal; and an elevator controller, the controller interfaced with the hall call devices, the controller programmed to:

(a) calculate a call cost for each elevator car by:

(i) inferring a destination from the new hall call signal, (ii) calculating an estimated time to the inferred destination for the elevator car, (iii) calculating system degradation factors for the elevator car, and (iv) summing the system degradation factors and adding the sum of the system degradation factors for the car to estimated time to the inferred destination; and (b) assign the new hall call to the car having the lowest call cost.

8. Elevator control system software for programming an elevator controller to assign one of a plurality of elevator cars to a new hall call, the software comprising:

an inferred destination function for inferring a destination from a new hall call signal;

an estimated time to destination function for calculating the estimated time to the inferred destination;

a system degradation factor function for calculating for each elevator car system degradation factors for the car's existing car calls and existing hall calls;

a function for calculating for each elevator car a call cost according to the following:

$$CC = \sum_{k=1}^{n} SDF_k + ETID$$

wherein there are n existing car and hall calls (k); and a car assignment function for assigning the car with the lowest call cost value to the new hall call.

9. An elevator control system comprising:

a means for receiving a new hall call signal, a means for inferring a destination from the new hall call signal and calculating an estimated time to the inferred destination;

a means for calculating a system degradation factor (SDF) for each elevator car's existing hall calls and car calls;

a means for calculating a call cost for each elevator car; and a means for assigning the new hall call to the elevator car having the lowest call cost.

10. The elevator control system of claim 9, wherein the means for calculating the call cost performs the calculation according to the following equation:

$$CC = \sum_{k=1}^{n} SDF_k + ETID$$

wherein there are n existing car and hall calls (k).

* * * * *